US005410787A

United States Patent [19]

Graf et al.

[11] Patent Number: 5,410,787

[45] Date of Patent: May 2, 1995

[54] APPARATUS FOR STRETCHING A SYNTHETIC YARN IN A STRETCHING BATH

[75] Inventors: Felix Graf; Vittorino Arnosti, both of Winterthur, Switzerland

[73] Assignee: Maschinenfabrik Rieter AG, Winterthur, Switzerland

[21] Appl. No.: 205,722

[22] Filed: Mar. 4, 1994

[30] Foreign Application Priority Data

May 3, 1993 [CH] Switzerland ..... 00674/93

[51] Int. Cl.[6] ..... D02J 1/22; D01D 5/14

[52] U.S. Cl. ..... 28/246; 28/240; 425/71

[58] Field of Search ..... 264/211.17, 290.5; 425/71; 28/240, 246

[56] References Cited

U.S. PATENT DOCUMENTS

| | | | |
|---|---|---|---|
| 2,982,994 | 5/1961 | Fernstrom | 254/211.17 |
| 3,002,804 | 10/1961 | Kilian | 425/71 X |
| 3,905,381 | 9/1975 | Meyer | 425/71 X |
| 4,064,605 | 12/1977 | Akiyama et al. | 28/240 X |
| 4,415,521 | 11/1983 | Mininni et al. | 264/211.17 |
| 5,046,225 | 9/1991 | Graf . | |
| 5,307,547 | 5/1994 | Graf | 28/240 X |

FOREIGN PATENT DOCUMENTS

| | | |
|---|---|---|
| 468918 | 7/1991 | European Pat. Off. . |
| 0468918A1 | 1/1992 | European Pat. Off. . |

*Primary Examiner*—John J. Calvert

*Attorney, Agent, or Firm*—Burns, Doane, Swecker & Mathis

[57] ABSTRACT

Stretching apparatus for synthetic filaments is provided with plates (5.1 and 5.2) located in a stretching bath S in spaced apart facing relation to one another to provide a space between which the filaments are drawn along a path. The plates are structured in accordance with the invention (as shown in FIGS. 7 to 16*a*) so that vibration of the yarn during the passage through the stretching bath is suppressed. At least one of the plates is penetrated by holes which open at the plate surface facing the yarn path.

14 Claims, 5 Drawing Sheets

38,39
28
29
5.1,5.2
26
40
27
30
31
32
33
34
35
IV
V

APPARATUS FOR STRETCHING A SYNTHETIC YARN IN A STRETCHING BATH

FIELD OF THE INVENTION

The invention relates to apparatus for stretching synthetic filaments. It is concerned particularly with stretching apparatus of the type in which one or more filaments (a yarn) are moved along a path between two guide surfaces in a liquid bath.

BACKGROUND AND SUMMARY OF THE INVENTION

From the U.S. Pat. No. 3,002,804, it is known to draw a synthetic yarn by means of a stretching bath. In the system of the patent, the yarn is guided through a stretching bath of relatively large volume. The bath is open at its upper end and provided at its lower end with an outlet opening for the yarn. As seen in cross section, the stretching bath is substantially larger than the cross section of the yarn bundle as seen in the running direction of yarn. There is sufficient space to allow some of the liquid entrained by and moving along at high speed with the yarn to move laterally along the floor of the vessel as the yarn exits. The liquid adhering to the yarn and exiting with the yarn at the lower part of the vessel is separated therefrom by means of centrifugal force upon deflection of the yarn.

A disadvantage of this prior apparatus is that the resistance of the yarn in the bath has to be altered by varying the level of the liquid or the viscosity or specific gravity of the liquid.

In order to overcome this disadvantage, the owner of the present invention has proposed in U.S. Pat. No. 5,046,225, an apparatus in which the yarn is pulled through a relatively narrow duct. In a commonly owned European patent application No. 04 68 918 A1, a further development is disclosed wherein, with the help of a plate located between the path of the yarn and the casing wall, a circulatory flow is enabled which flows in the zone of the yarn in the direction of movement of the yarn, and which flows in the opposite direction between the said plate and the chamber wall.

In a further development of this idea, there are two spaced apart plates between which the yarn path extends. Within the chamber the yarn and the liquid sucked along with the yarn are guided between the plates, and a counterflow arises between each plate and the respective chamber wall so that a liquid circulation arises. In this system there is a possibility of varying the distance between the two plates in order to change the friction between the yarn and the liquid.

The variable braking effect between the plates will only arise when there is a relatively small distance between the two plates of one millimeter, for example. However, it has been observed (e.g., with the help of a window) that the yarns assumed a serpentine course because deflections transverse to the direction of the run of the yarn occurred, particularly at the exit.

An object of the present invention to eliminate such deflections and to achieve a yarn course which extends in a stretched form through the stretching bath. In accordance with the invention, at least one of the opposed walls between which the yarn passes during stretching is provided with a structured surface facing the yarn to suppress vibrations of the yarn. One or both of the plates on opposite sides of the yarn path may be penetrated by holes which open up into the zone where the yarn is being drawn. An advantage of the invention is that, on the one hand, the yarn is carried in stretched form and, on the other hand, the braking effect on the yarn in the stretching bath can be varied.

BRIEF DESCRIPTION OF THE DRAWINGS

The invention now will be explained with reference to the embodiments shown in the drawings, in which:

FIGS. 7 to 11 and 13, 15 and 16 each show a cross section along line IV—IV (FIGS. 7*a* to 11*a* and 13*a*, 15*a*) of a plate for insertion into the stretching bath of the above Figures in accordance with the invention;

FIGS. 12 and 14 show views in the direction of the arrows V in FIGS. 12*a* and 14*a*; and FIGS. 7*a* and 8*a* to 16*a* show top views of the plate surfaces of FIGS. 7 to 16.

DETAILED DESCRIPTION OF PREFERRED EMBODIMENTS

Figure 1:
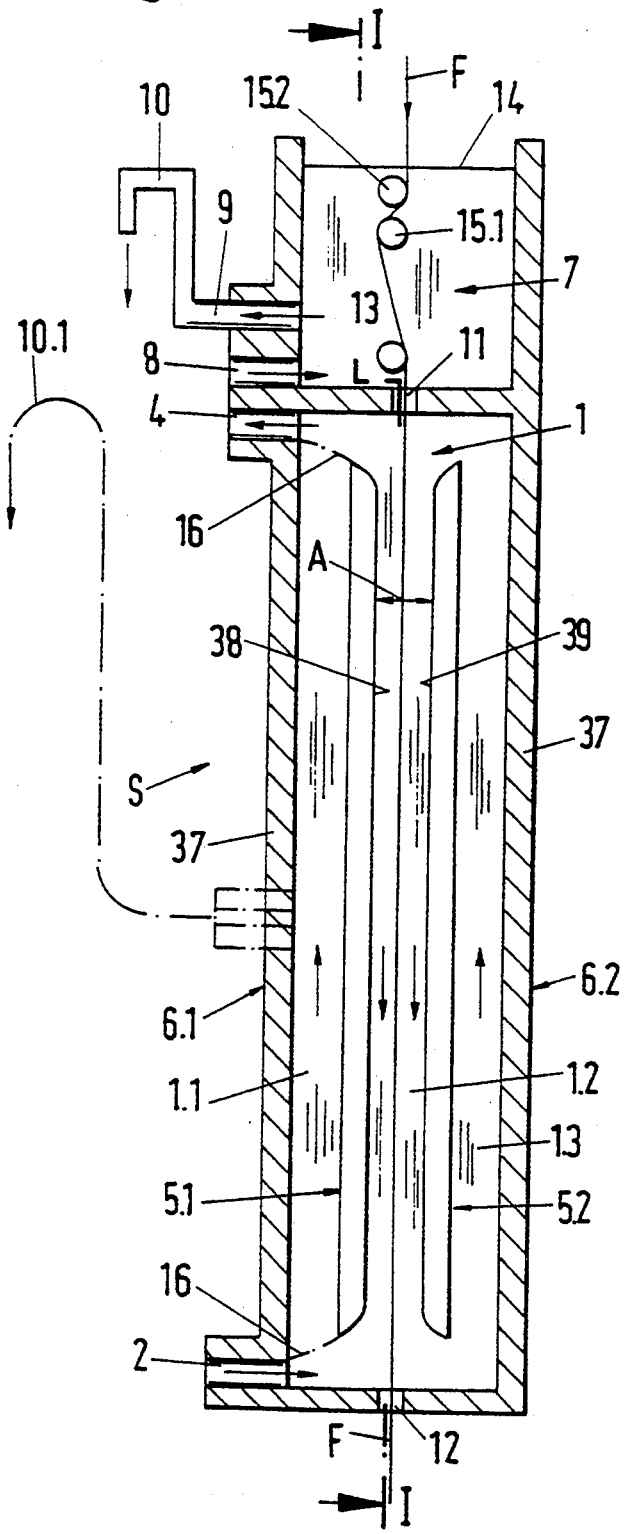
FIG. 1 is a cross section along line III—III in FIG. 3 through a stretching bath of a type to which the present invention relates.
Figure 2:
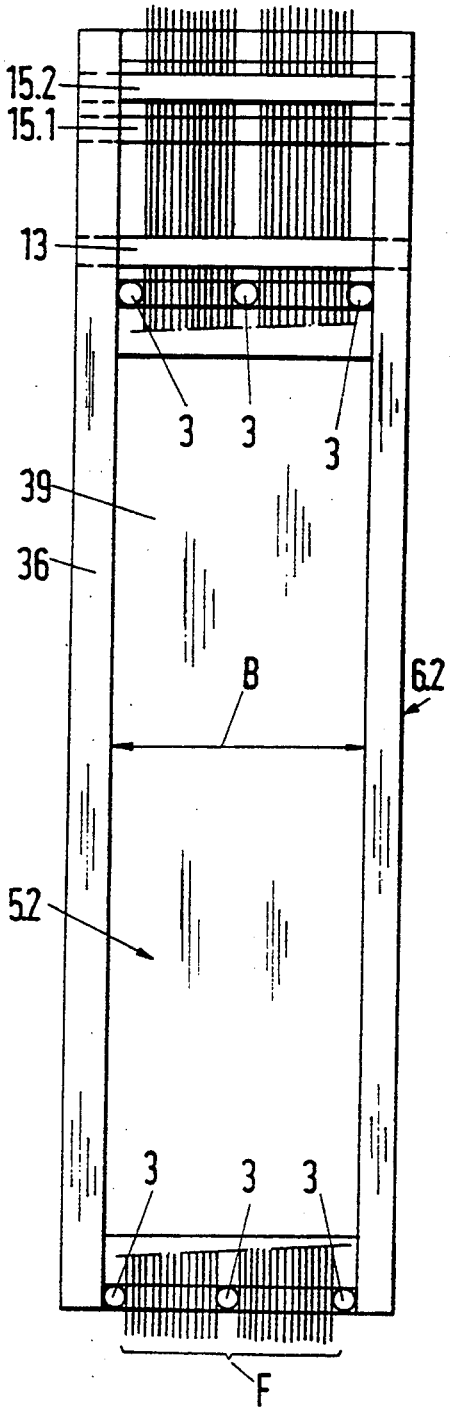
FIG. 2 shows the right half of the stretching bath of FIG. 1, as seen from the left of FIG. 1.

FIG. 1 shows an apparatus S for stretching a synthetic yarn F, which, as is shown in FIG. 2, may consist of two filament bundles. Other suitable yarns might comprise a single bundle or several such filament bundles. The apparatus comprises a left half 6.1 and a right half 6.2. These are detachably connected together for separation so as to allow introduction of the filament bundle F into the apparatus S. Such apparatus is shown and described in U.S. Pat. No. 5,046,225 and its counterpart European patent application No. 0 384 886 A1, and in U.S. Pat. No. 5,307,547 and its counterpart European patent application No. 0 468 918 A1, all which are incorporated herein by reference in their entireties.

The apparatus S as shown in FIG. 1 comprises a main chamber 1 which is composed of side chambers 1.1 and 1.3 and of intermediate chamber 1.2. Between the side chamber 1.1 and the intermediate chamber 1.2, a plate 5.1 is provided and between side chamber 1.3 and the intermediate chamber 1.2 a plate 5.2 is provided. These plates extend, as is shown in FIG. 2, over the whole width B of the chambers 1, 1.1, 1.2 and 1.3.

As a variation, there is the option of omitting side chamber 1.1 by closing this chamber, as is indicated in the dot-dash lines 16. This option also is present with respect to embodiments of FIGS. 3, 4 and 6.

In the lower part of main chamber 1, an entrance 2 is provided for the liquid of the stretching bath. In the upper end of the main chamber 1 an outlet 4 is provided for this liquid.

A slot-like entrance opening 11 (shown in enlarged form for clarity) for the yarn bundle F is provided at the upper end of main chamber 1. The filament bundle moves through a trough 7 prior to its entrance through said slot-like entrance opening 11 into the main chamber 1. The yarn is deflected on deflection rods 15.2, 15.1 and 13 so as to achieve a careful guidance of the yarn bundle into the slot plane.

The trough 7 usually also contains the same liquid which is filled into the main chamber 1, this being at a level which is indicated by reference numeral 14. Such liquid is filled into trough 7 through an entrance 8 and carried off through exit 9, where an adjustable U-tube 10 may be provided so as to define the level 14.

The illustrated distance A between the guide walls 38 and 39 of plates 5.1 and 5.2 is not equivalent to the distance used in practice. In practice, a distance on the order of one millimeter or less is selected ordinarily. This is determined by trial and can vary owing to the viscosity and temperature of the liquid and the thickness of the yarn bundle.

Slots 11 and 12 are dimensioned so that only the liquid which adheres to the yarn bundle F passes from trough 7 to the main chamber 1 or from the main chamber 1 to the exterior of the apparatus. For slot 12 this condition exists in cases where trough 7 is not provided with the same type of liquid as main chamber 1.

FIG. 2 shows that the two illustrated yarn bundles F are kept apart by the guide pin or bolt 3. These bundles extend over the whole width of slots 11 and 12. FIG. 2 also shows that the deflection rods 13, 15.1 and 15.2 are attached stationarily in the side walls 36 of the respective stretching bath halves 6.1 and 6.2.

The operation of the apparatus has already been explained in U.S. Pat. No. 5,046,225 and the previously mentioned European patent applications. The two stretching bath halves 6.1 and 6.2, as shown in FIG. 1, are brought together after the introduction of the yarn bundle(s) so as to close the chambers. Thereafter, liquid is introduced into main chamber 1 via the entrance 2 until the liquid exits at exit 4. Trough 7 is filled subsequently to the desired level via the entrance 8. The stretching of the yarn with the various stretching stages is carried out as disclosed in said European patent applications.

Figure 3:
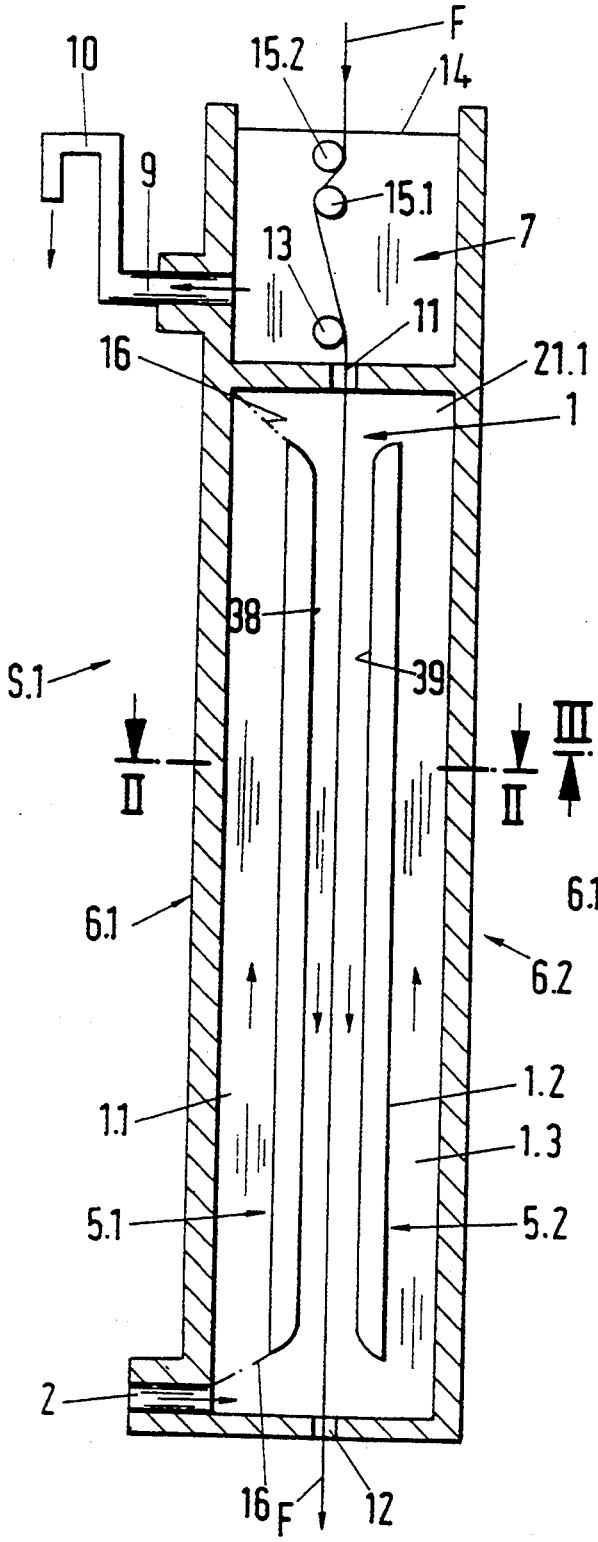
FIG. 3 shows a variation of the stretching bath of FIG. 1.
Figure 3A:
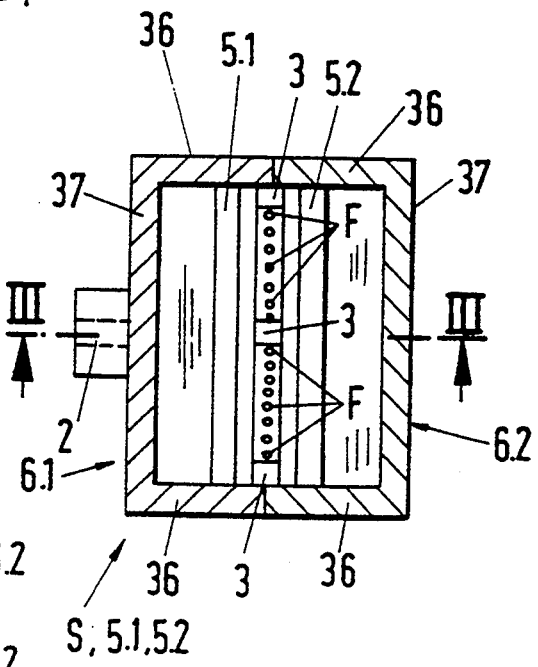
FIG. 3*a* shows a cross section along line II—II of FIG. 3 through the stretching bath of FIG. 3.

In FIG. 3 there is shown a variation wherein the liquid for the trough 7 is filled in through entrance 2, and the slot 11 is wider so that the trough 7 can be filled with the same liquid of main chamber 1. The descriptions for FIG. 1 apply also to the apparatus in accordance with FIG. 3, with the exception that two different liquids for the main chamber 1 and the trough 7 cannot be selected.

Figure 4:
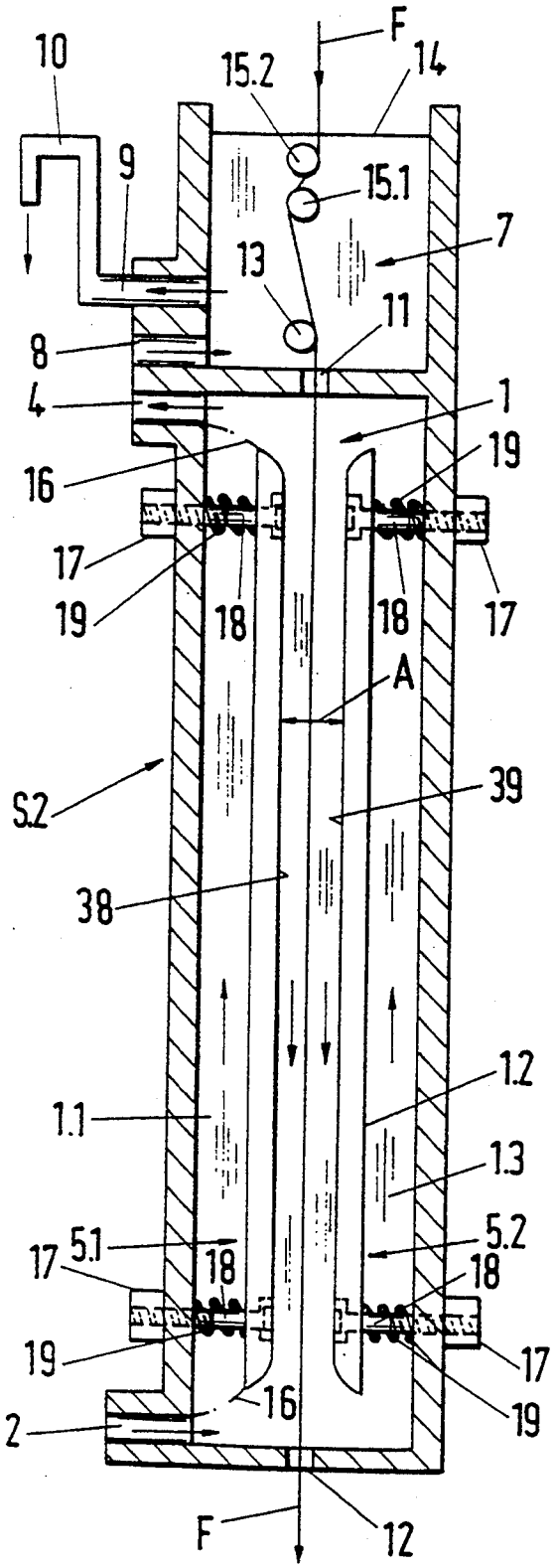
FIG. 4 shows a further variation of the stretching bath of FIG. 1.
Figure 5:
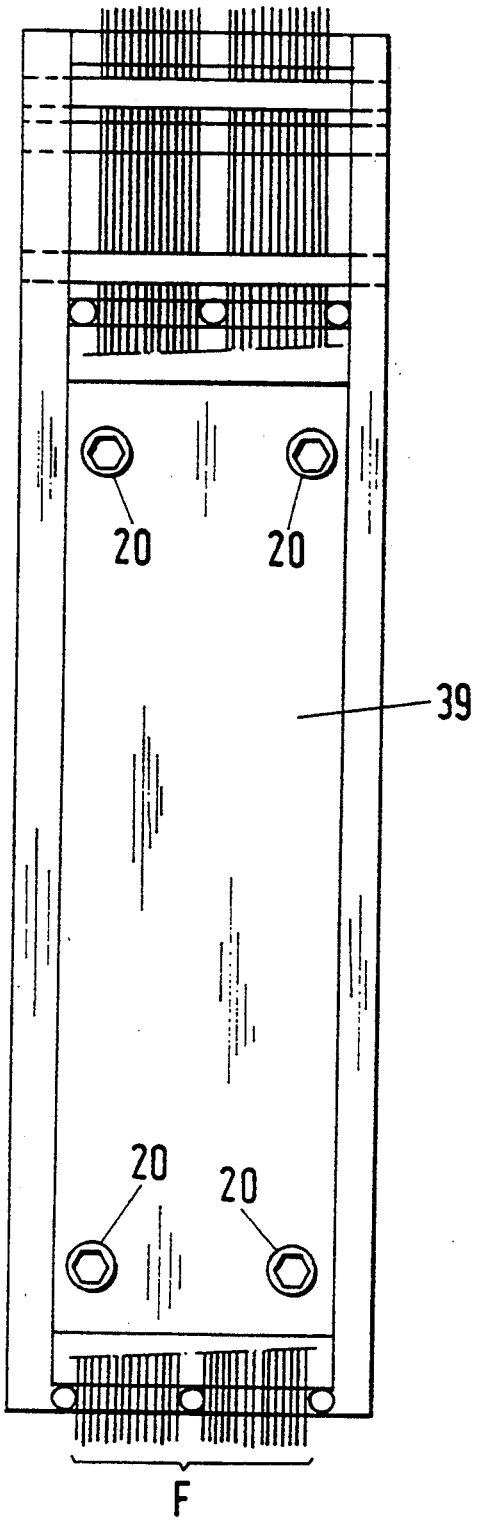
FIG. 5 shows the right half of the stretching bath of FIG. 4, as seen from the left of FIG. 4.

FIG. 4 shows the possibility of providing adjustably mounted plates. The plates can be displaced by means of screws 18 received threadedly in nuts 17 fixed in front walls 37 provided at a right angle to the side walls 36 (FIG. 3). Screws 18 are surrounded in side chambers 1.1 and 1.3 by pressure springs 19 which press the plates 5.1 and 5.2 inwardly so as to maintain the predefined distance A. In all other respects, this apparatus is equivalent to that shown in FIGS. 1 and 2.

Figure 6:
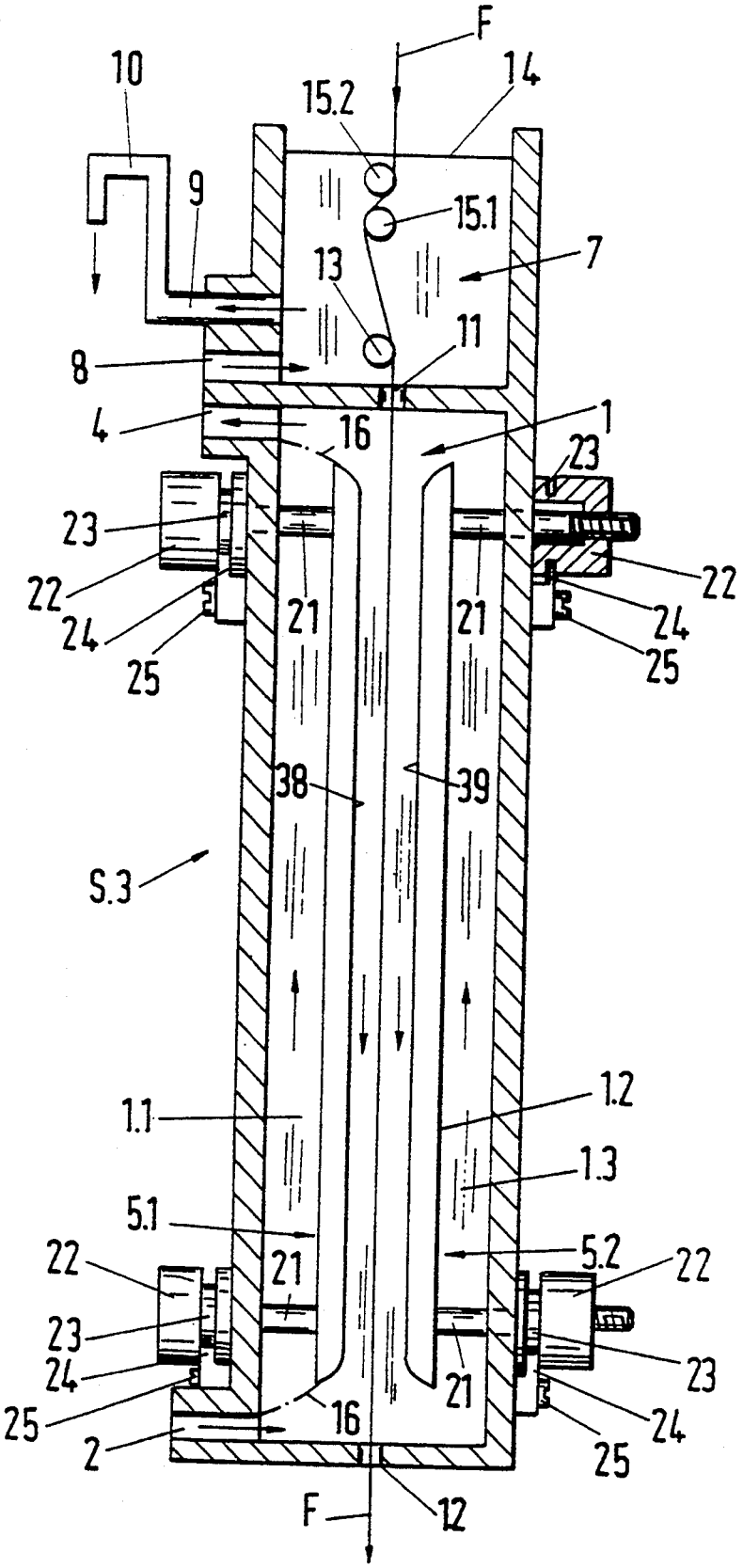
FIG. 6 shows a variation of the stretching bath of FIG. 4.

FIG. 6 shows a different variation for the adjustment of the plates 5.1 and 5.2. In FIG. 6, the plates 5.1 and 5.2 are each provided with screw bolts 21 which are received by adjusting nuts 22 held in position by a guide comb 24 which engages in a guide groove 23 in the adjusting nut. The upper adjusting nut 22 on the right side, as seen in FIG. 6, is shown in a sectional view. The other elements of FIG. 6 are equivalent to those shown in FIG. 1.

Figures 7, 7A, 8, 9, 9A, 10, 10A, 11, 11A, 12, 12A, 13, 13A, 14, 14A, 15, 15A, 16, 16A:
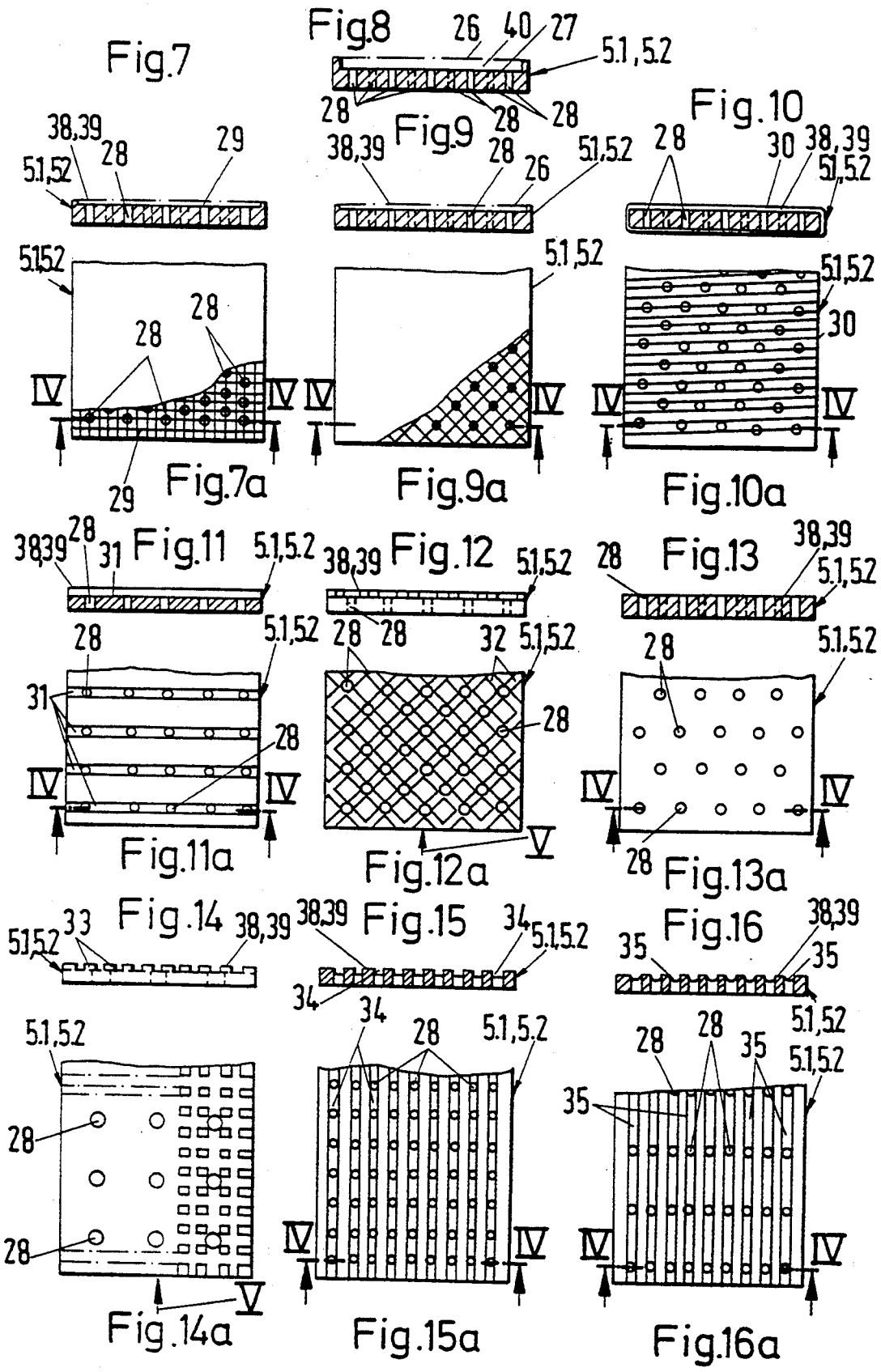

FIGS. 7 to **16*a* show embodiments of plates 5.1 and/or 5.2 configured so as to eliminate the vibrations of the filament bundle as mentioned above. In considering these views, it should be understood that the paths of the filaments would be above the plate structures as illustrated in FIGS. 7, 8, 9**, etc.

FIGS. 7 and **7*a* show a plate penetrated by bores or holes 28 distributed over the area of the plate and having a gridiron 29 arranged over the top (as seen in FIG. 7**) of the plate. The stretching bath is directed opposite of the filament bundle. The gridiron is attached in a usual manner.

FIG. 8 principally shows the plate of FIG. 7, but with a recess 27 so as to provide more space between the gridiron 26 and the floor of recess 27. This allows a higher probability for a balance of the liquid from bore to bore. The gridiron is marked with reference numeral 26 in FIG. 8. There is the principal possibility, however, to provide a gridiron in accordance with gridiron 29 of FIGS. 7 and **7*a*. There is also the possibility (not shown) of omitting the bores 28**.

In all the figures to be described below, it is plates indicated 5.1 and/or plates 5.2 that are concerned. In contrast to a gridiron arranged at a right angle of FIGS. 7 and **7*a*, FIGS. 9 and 9*a* show a gridiron with diagonally arranged grid rods. FIGS. 7*a* and 9*a* show a bore 28** directly below a point of intersection of the gridiron rods. However, this is not the only possibility. The bores can also be provided within a square or rectangle or rhomboid formed through the gridiron rods.

FIG. 10 shows a variation in which, instead of a gridiron, windings of wires are wound around plates 5.1 and 5.2. This also provides the possibility of enabling a balance of the liquid between bores 28.

FIGS. 11 to **16*a* are not provided with any gridirons or wire windings. FIG. 11 shows transverse grooves or flutes 31 into which bores 28 open. The plate of FIG. 12 is provided with diagonal grooves instead of transverse grooves, and the bores 28 in FIG. 12 open out into the points of intersection of the diagonal grooves. It is also possible to provide bores displaced from such points of intersection. FIGS. 13 and 13*a* show a plate 5.1 or 5.2 provided with bores 28** which are arranged here only in graduations.

In principle, the bores may be provided with different diameters and different numbers of bores per unit of area. The number of bores as well as their diameter have to be determined by trials, in order to determine which combination results in a straight filament bundle path.

FIGS. 14 and **14*a* show cube-like elevations 33 as well as bores 28. FIGS. 15 and 15*a* show transverse grooves with a rectangular cross section and bores 28, whereas FIGS. 16 and 16*a* show longitudinal grooves of semicircular cross section and also bores 28**.

The variations of the plate surface shown herein in combination with the bores are to illustrate that precautions are made which substantially prevent the vibrations of the yarns or yarn bundles during their passage.

The invention is not limited to the stretching of a plurality of fibrils per yarn. It is applicable also to the processing of one fibril per yarn, i.e., to a monofilament.

Finally, as shown in FIG. 1 in dot-dash lines, a liquid level control 10.1 can be provided which operates in analogy to the liquid level control 10, so that the liquid level (and hence the portion of the plate length immersed in the liquid) is controllable. The length of the predefined path and thus the braking effect exerted on the yarn in the stretching bath can be varied by varying the liquid level.

What is claimed is:

1. An apparatus for stretching a synthetic yarn comprising two guide walls which are situated in a stretching bath and which are situated during the operation at a predefined distance from one another in a braking liquid, at least one of said guide walls being provided with a structured surface situated opposite the yarn in the braking liquid, with the yarn being guided along a predefined path substantially parallel to and adjacent said surface so that vibration of the yarn is suppressed, said at least one guide wall being a plate provided with a plurality of holes penetrating the plate to produce the structured surface.

2. An apparatus as claimed in claim 1, wherein the structured surface also includes recesses into which said holes open out.

3. An apparatus as claimed in claim 1, wherein the structured surface also includes a lattice stretched over the surface of the plate.

4. An apparatus as claimed in claim 1, wherein the structured surface also includes wire windings stretched over said plate.

5. An apparatus as claimed in claim 3, including an intermediate space provided between the lattice and the surface of the perforated plate.

6. An apparatus as claimed in claim 2, wherein the recesses are grooves directed transversely to the direction of movement of the yarn.

7. An apparatus as claimed in claim 2, wherein the recesses are grooves directed in the direction of movement of the yarn.

8. An apparatus as claimed in claim 2, wherein the recesses are grooves directed in an inclined direction relative to the direction of movement of the yarn.

9. An apparatus as claimed in claim 2, wherein the recesses are grooves, some of which are directed transversely to the direction of movement of the yarn, and some of which are directed in the direction of movement of the yarn, and wherein said holes open out into predefined points of intersection of the grooves.

10. An apparatus as claimed in claim 1, including means for changing said predefined distance.

11. An apparatus as claimed in claim 1, including means for changing the length of said predefined path.

12. An apparatus as claimed in claim 11, wherein said means for changing the length of the predefined path also changes a level of the braking liquid in the stretching bath with said guide walls being arranged stationarily.

13. An apparatus as claimed in claim 10, wherein said means for changing the predefined distance includes at least one of the guide wails being movable to adjust a position of the at least one guide wall.

14. Apparatus for stretching synthetic filaments comprising a stretching bath containing liquid through which the yarn is drawn under tension with said liquid exerting drag forces on the yarn, said stretching bath being provided with two opposed walls having opposed surfaces situated in the liquid of the stretching bath in spaced apart relation at a predefined distance from one another, said yarn passing through the space between said walls and substantially parallel to at least one of said walls and entraining some of said liquid, at least one of said walls being in the form of a plate penetrated by holes.

* * * * *